United States Patent [19]

Reid et al.

[11] Patent Number: 4,637,667

[45] Date of Patent: Jan. 20, 1987

[54] POSITIVE INTERLOCK FOR FILE CABINET

[75] Inventors: Iain K. Reid, Scarborough; Eric Staite, Toronto; Doug Richmond; George Rumbelow, both of Scarborough, all of Canada

[73] Assignee: Joyce International, Inc., Great Neck, N.Y.

[21] Appl. No.: 734,832

[22] Filed: May 16, 1985

[51] Int. Cl.[4] ..... E05B 65/46

[52] U.S. Cl. ..... 312/217; 312/216; 312/221

[58] Field of Search ..... 312/216, 217, 220, 218, 312/219, 221

[56] References Cited

U.S. PATENT DOCUMENTS

| | | | |
|---|---|---|---|
| 4,239,309 | 12/1980 | De Fouw | 312/216 X |
| 4,272,138 | 6/1981 | Stark | 312/216 X |
| 4,355,851 | 10/1982 | Slusser | 312/217 X |
| 4,429,930 | 2/1984 | Blouin | 312/216 |
| 4,447,098 | 5/1984 | Parker | 312/216 |

*Primary Examiner*—James T. McCall

*Attorney, Agent, or Firm*—Stephen E. Feldman

[57] ABSTRACT

A lateral type file cabinet is provided with a predetermined number of file drawers suspended therein for movement between drawer open and drawer closed positions. Lock and interlock mechanisms are provided in the cabinet for coaction with the drawers to prevent withdrawal of more than one drawer at a time and to lock all drawers in the cabinet. The interlock mechanism includes a stack of interlock bars; their being one less bar than the number of drawers. Each bar includes an upper an a lower actuator block; with the blocks disposed for coaction with the radiused leading edge of an interlock track carried by each drawer. When a drawer is pulled from the cabinet the interlock track engages the appropriate actuator block to raise its bar and all interlock bars thereabove. The actuator blocks on the raised bars prevent movement of all drawers above the open one. The interlock track of the open drawer coacts with the actuator block on the interlock bar therebelow to prevent movement thereof, of all bars therebelow and of drawers below the open drawer. An extender is slidably disposed on each interlock track to facilitate movement of the drawers to full extension and for coaction with the actuator blocks and interlock bars to maintain the interlocked condition once set. The lock mechanism includes two key actuated lock bars one of which is disposed in close proximity to the interlock bars.

15 Claims, 7 Drawing Figures

FIG. 2
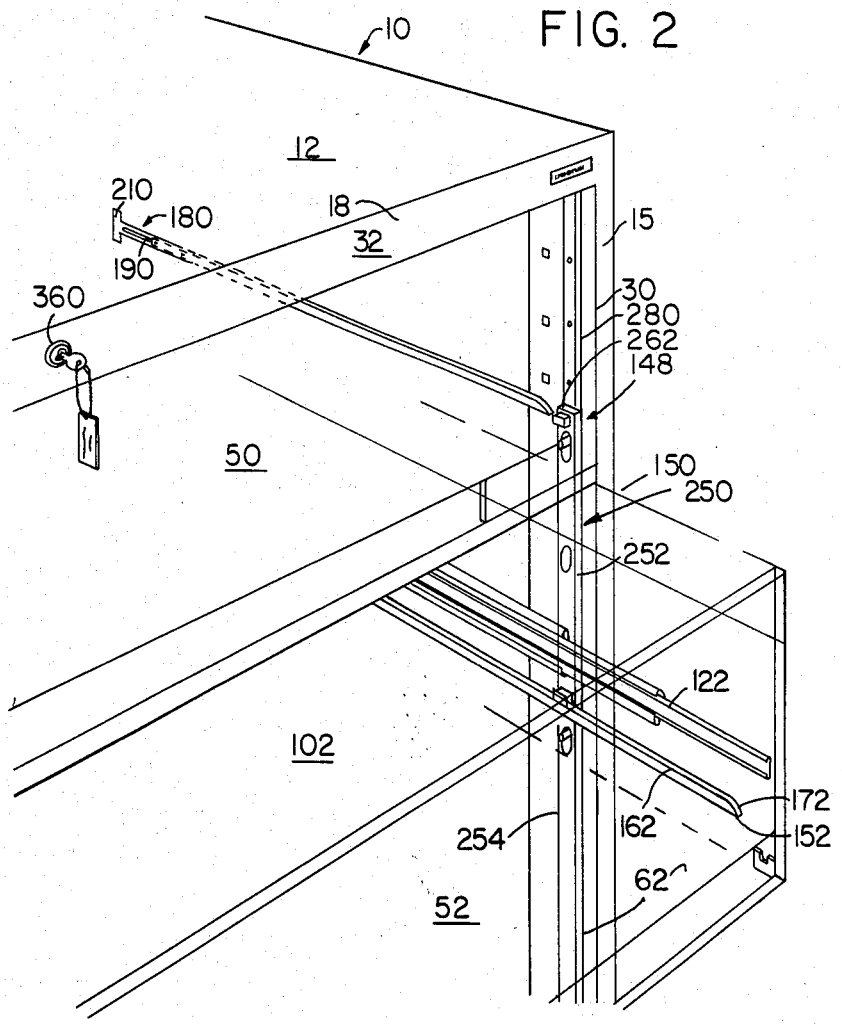
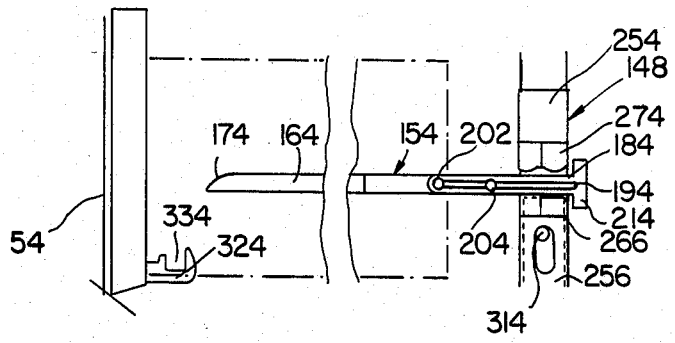
FIG. 5

POSITIVE INTERLOCK FOR FILE CABINET

BACKGROUND OF THE INVENTION

1. Field of Application

This invention relates to file cabinets; and more particularly to positive interlocks for lateral filing cabinets.

2. Description of the Prior Art

Filing cabinets, of the type that are commonly found in offices, businesses and homes, for filing documents, papers and the like are generally of the vertical and lateral type. Such filing or file cabinets usually include a number of file drawers each of which, by way of example and explanation, has a width, a height and a length. In a vertical file the length of the drawer is moved out from the body of the file cabinet to obtain access to the drawer space; while in a lateral file the drawer is moved transverse to its length to obtain access to the drawer space.

One prevalent problem with lateral type filing cabinets is that there is a tendency of the cabinet to tip over if more than one drawer is moved to open position at a time. This seems to be due to a shift in the center of gravity such that the cabinet becomes unstable in the forward (drawer opened) direction. Obviously, a falling filing cabinet can be a dangerous object which can, and sometimes does, injur the party in front of the cabinet. In addition, if the cabinet falls over, the drawers and cabinet may be damaged and stored materials upset and damaged also.

One available method of preventing lateral files from tipping over is to attach the cabinet to a wall or other support if possible. This usually requires modification to the cabinet and restricts positioning of the filing cabinet where there is a wall or support the cabinet can be attached to.

Alternatively, mechanisms have been devised for mechanically interlocking the cabinet drawers in such a manner that withdrawal of one drawer hinders or prevents withdrawal of all other cabinet drawers. One type of such available interlock mechanism is shown in Canadian Letters Pat. No. 1,038,010 issued Sept. 5, 1978 to C. C. Pergler for *Safety and Drawer Movement Sequencing Control Arrangement For File Cabinets.* However, Pergler requires a dual bar system; one of which consists of a stack of latch bars actuated by a cam of a moving drawer, and the other of which acts in response to movement of the first latch bar to latch all closed drawers shut until the opened drawer is returned to closed position. Not only is the Pergler type mechanism relatively highly complex, and thus relatively expensive, but it will also not prevent simultaneous opening of two cabinet drawers.

Another available type of interlock mechanism is shown in Canadian Letters Pat. No. 1,133,564 issued on Oct. 12, 1982 to L. Terlecki for *Lateral File And Interlock.* This type of interlock mechanism provide an interlock latch bar for each cabinet drawer, with the latch bars arranged in a vertical stack or array so that they can coact with each other as well as with their respective cabinet drawers. The stack of latch bars are sized and arranged in the cabinet to take up all the vertical space therein; except for a space the size of an interlock channel, one of which is attached to each cabinet drawer side. In this type of interlock mechanism when a cabinet drawer is moved to open position the channel is moved between a corresponding set of latch bars to fill the single available space and lift up all latch bars thereabove in the cabinet. Resistance to any attempt to thereafter open a second drawer, above the opened drawer, is provied by the top of the cabinet which prevents further upward movement of the latch bar stack. Continued force to so open a second drawer could thus damage either the cabinet top or one or more of the latch bars. In addition, such mechanisms require the expense of providing a latch bar for each cabinet drawer.

Other available types of interlock mechanisms are shown in Canadian Letters Patent No. 1,037,092 issued on Aug. 22, 1978 to G. Brekner et all for *Office Appliance;* Canadian Letters Patent No. 1,037,093 issued on Aug. 22, 1978; and Canadian Letters Patent No. 1,114,883 issued on Dec. 22, 1981. All such mechanisms not only also require a stack of latch bars including a latch bar for each drawer; but also actuate the latch bars by way of cams which must be first moved to a latch bar actuating condition and thereafter returned to an unactuated condition. Thus again, there is an undesirable expense and relative complexity of a latch bar for each drawer; as well as the undesirable relative expense of the cams and their operation.

Still other available types of interlock mechanisms connect an interlock track to the side of each cabinet drawer; but, must do so, so that the track is slotted to provided for relative movement between the track and drawer. This action is necessary to accommodate the overall length of the cabinet and the required travel to allow a drawer to be fully opened. However, the resulting undesirable effect is that all drawers can be opened a relatively small amount but one which may be enough to shift the cabinet's center of gravity and cause tipping of the cabinet.

SUMMARY OF THE INVENTION

It is therefore an object of this invention to provide a new and improved file cabinet.

It is another object of this invention to provide a new and improved drawer interlock for a file cabinet.

It is yet another object of this invention to provide a new and improved drawer interlock for a lateral type file cabinet.

It is still another object of this invention to provide a new and improved file cabinet with its drawers interlocked so that only one drawer can be opened at a time.

It is yet still another object of this invention to provide a new and improved lateral type file cabinet with its drawers interlocked so that only one drawer can be opened at a time.

It is a further object of this invention to provide a new and improved drawer interlock and drawer lock for a lateral type file cabinet.

This invention involves drawer interlocks for file cabinets and more particularly lateral type file cabinets; and contemplates providing same: so that there are less interlock bars than the number of drawers; so that each interlock bar is provided with extension means to facilitate movement of the drawer to a fully extended position; and so that the cabinet lock system and interlock system can be located in the same area of the file cabinet.

Other features and advantages of the invention in its details of construction and arrangement of parts will be seen from the above, from the following description of the preferred embodiment when considered with the drawing, and from the appended claims. In addition, these and other objects and advantages of the present invention will become evident from the description which follows.

BRIEF DESCRIPTION OF THE DRAWING

In the drawing:

FIG. 2 is an enlarged perspective view of the upper right hand portion of the file cabinet of FIG. 1 with parts in phantom to better show details of the instant invention;

FIG. 5 is a side elevation view of a portion of the file cabinet of FIG. 3 but showing the drawer thereof fully extended;

DESCRIPTION OF THE PREFERRED EMBODIMENT

For convenience, the invention will be described as applied to a four drawer lateral type file cabinet of the type wherein the drawers each have a drawer front that is fixedly attached to the drawer sides; and wherein there is a lock mechanism, in addition to the drawer interlock mechanism, to lock all the cabinet drawers. It should be understood, nevertheless, that the cabinet can have any appropriate number of drawers, that the drawer fronts could be attached to the drawer sides to permit tilting of the drawer fronts, that alternatively the drawers need not be provided with drawer fronts but the cabinet instead have doors which open to permit drawer movement into and out from the cabinet and that the cabinet need not be provided with a lock mechanism at all.

Figure 1:
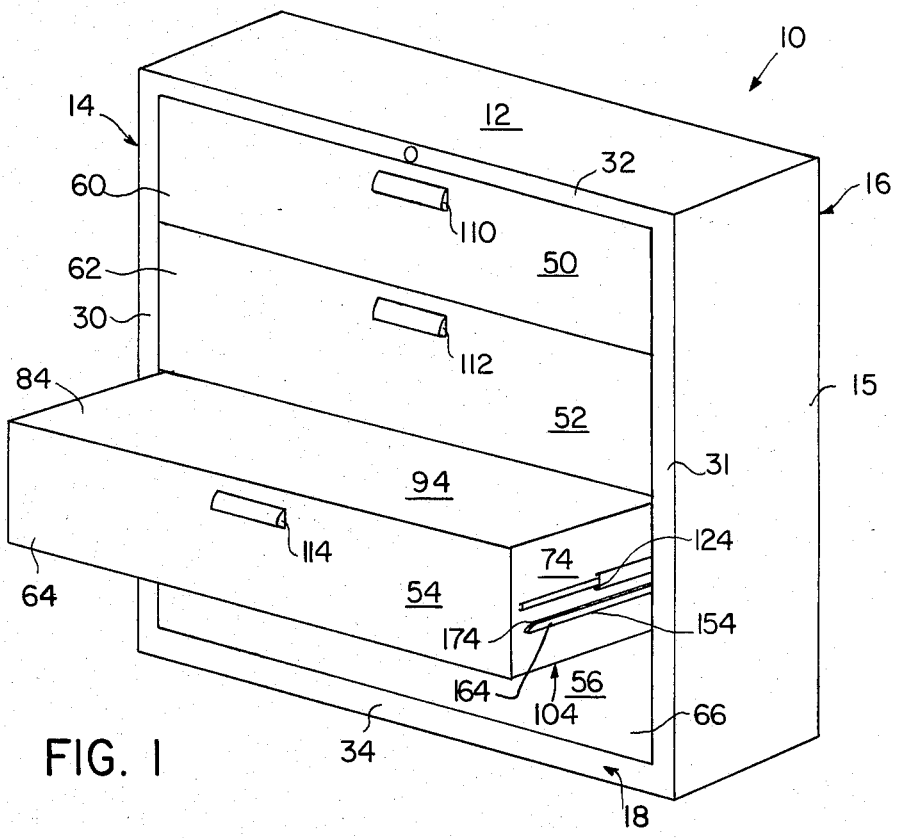
FIG. 1 is a schematic perspective view of a lateral type file cabinet incorporating the instant invention.

With reference to FIGS. 1 and 2, there is generally shown at 10 a lateral type file cabinet housing having a top 12, sides 14, 15, back 16, and front 18. Front 18 is in a frame like configuration and includes a pair of side strips 30, 31, an upper strip 32 and a lower or base strip 34. A plurality of file type drawers 50, 52, 54 and 56 provided for file cabinet 10; and are suspended within housing 10 for movement into and out from housing 10 as will be hereinafter explained.

Each drawer 50, 52, 54, 56, includes respectively: a drawer front 60, 62, 64, 66; a right side end panel 70, 72, 74, 76; a left side or end panel (only panel 84 for drawer 54 shown); a back panel (only back panel 94 for drawer 54 shown; and a bottom panel (only bottom panels 102, 104 for drawers 52, 54 shown); all assembled together to be open at the top to provide access into the space formed therewithin for the storage of files, materials or whatever it is desired to be stored therewithin. If desired drawers 50,52, 54, 56 may be formed without drawer fronts and housing 10 provided with doors which slide into housing 10; all in a conventional manner. Thus drawers 50, 52, 54, 56 may be regarded as shelves or generally as storage members. Each drawer 50, 52, 54, 56 is provided with a handle or pull 110, 112, 114, 116 in conventional manner; and with drawer release mechanism (not shown) to retains the drawers in their closed positions and release them for movement out of housing 10.

Housing 10 and drawers 50, 52, 54, 56 as well as other mechanisms to be described hereinafter are made from steel. However, other convenient materials such as aluminum may be utilized for appropriate parts; and wood or similar materials used for housing 10 and drawers 50, 52, 54, 56 if desired.

Each drawer 50, 52, 54, 56 is mounted to housing 10 through suspension means of conventional construction and operation (only the right side portion of suspension means 102, 104 for drawer 52, 54 is shown—a left side portion is also provided for each drawer).

A drawer interlock assembly 148 (FIGS. 2, 3, 5 and 6) is provided for cabinet 10. Interlock assembly 150 includes an interlock track 150, 152, 154, 156 each fixedly secured to its respective right side panel 70, 72, 74, 76 of its drawer 50, 52, 54, 56. All interlock tracks 150, 152, 154, 156 are of identical construction and include a body section 160, 162, 164, 166 having a radiused nose 170, 172, 174, 176 respectively. An extender (only extenders 180, 184, for interlock tracks 150, 154 respectively are shown) is provided for each interlock track; with each such extender formed with an elongated slot (only slot 194 for track 154 shown) and mounted to its respective body section by headed fasteners (only fasteners 200, 204 for tracks 150, 154 shown) so as to permit relative movement between the extender and its respective body section. Each extender terminates in a stop bar (only stop bars 210, 214 for extenders 180, 184 shown).

An interlock bar stack 250 (FIGS. 2 and 3) is provided for housing 10. Stack 250 includes a plurality of interlock bars 252, 254, 256 of identical construction and arranged in housing 10 for vertical sliding movement along right side 15 thereof and for cooperation with interlock tracks 150, 152, 154, 156 as will be hereinafter explained. Each interlock bar 252, 254, 256 respectively includes an upper actuator block 262, 264, 266 and a lower actuator block 272, 274, 276; and is formed of channel configuration. Interlock stack 250 is located in a vertical recess 280 (FIG. 2) in the frame of housing side 15 to prevent rotation thereof in a vertical plane. Drawer suspensions 102, 104 (and those for drawers 50, 56) retain interlock stack 250 in recess 280 and prevent rotation thereof in a horizontal plane. Interlock bars 252, 254, 256 are each formed of steel or other suitable material; while actuator blocks 262, 264, 266, 272, 274, 276 are all preferably formed of nylon (but other suitable materials may be used); and each includes a curved portion 263, 265, 267, 273, 275, 277 respectively.

A pin 282 (FIGS. 3 and 5) secured to side 15 of housing 10 and extending outwardly therefrom coacts with a bottom of interlock bar 256 and thus forms a lower stop for interlock stack 250. Pin 282 is preferably formed of nylon but other suitable materials may be used.

Figure 7:
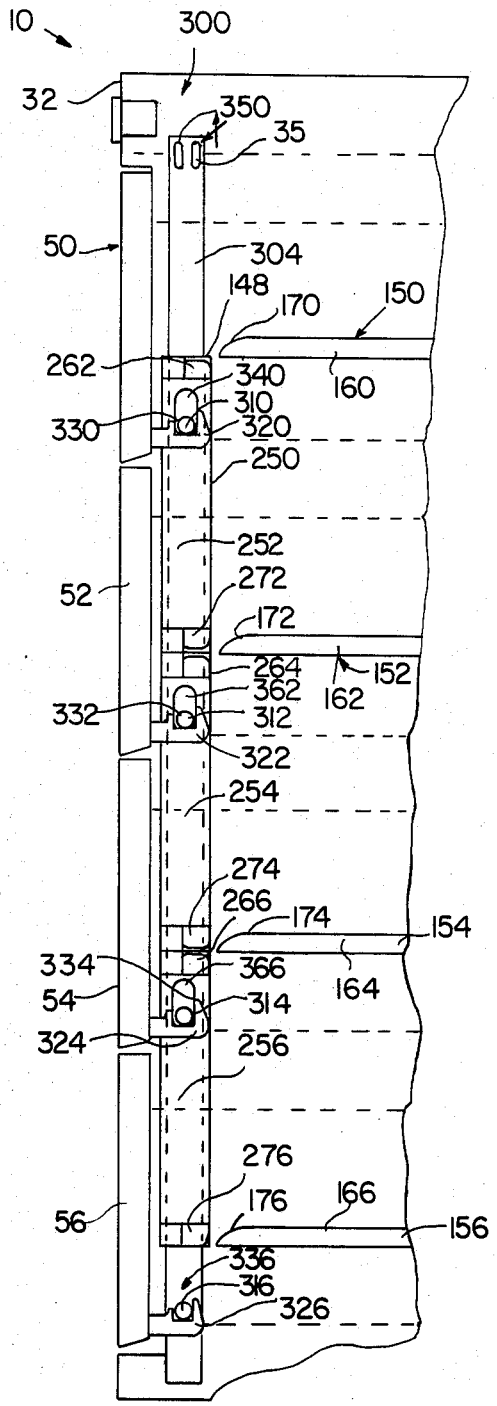
FIG. 7 is a side elevation view similar to FIG. 3 but showing the cabinet with all its drawers in locked condition.

When drawers 50, 52, 54, 56 are all in their respective closed positions (i.e. fully disposed within housing 10 - FIG. 7) interlock tracks 150, 152, 154, 156 thereof are as shown in FIG. 7 and interlock bars 252, 254, 256 are stacked one on top of the other with bar 256 resting on pin 282. Withdrawal of a drawer 50, 52, 54, 56 results in coaction between its respective interlock track 150, 152, 154, 156 and interlock stack 250 to prevent any withdrawal of another such drawer.

Figure 4:
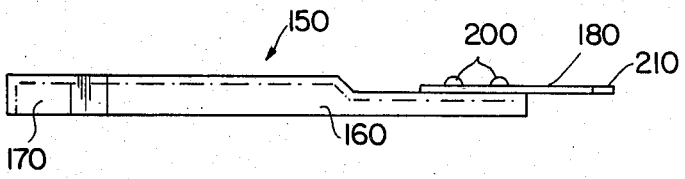
FIG. 4 is a top view of the interlock track.
Figure 3:
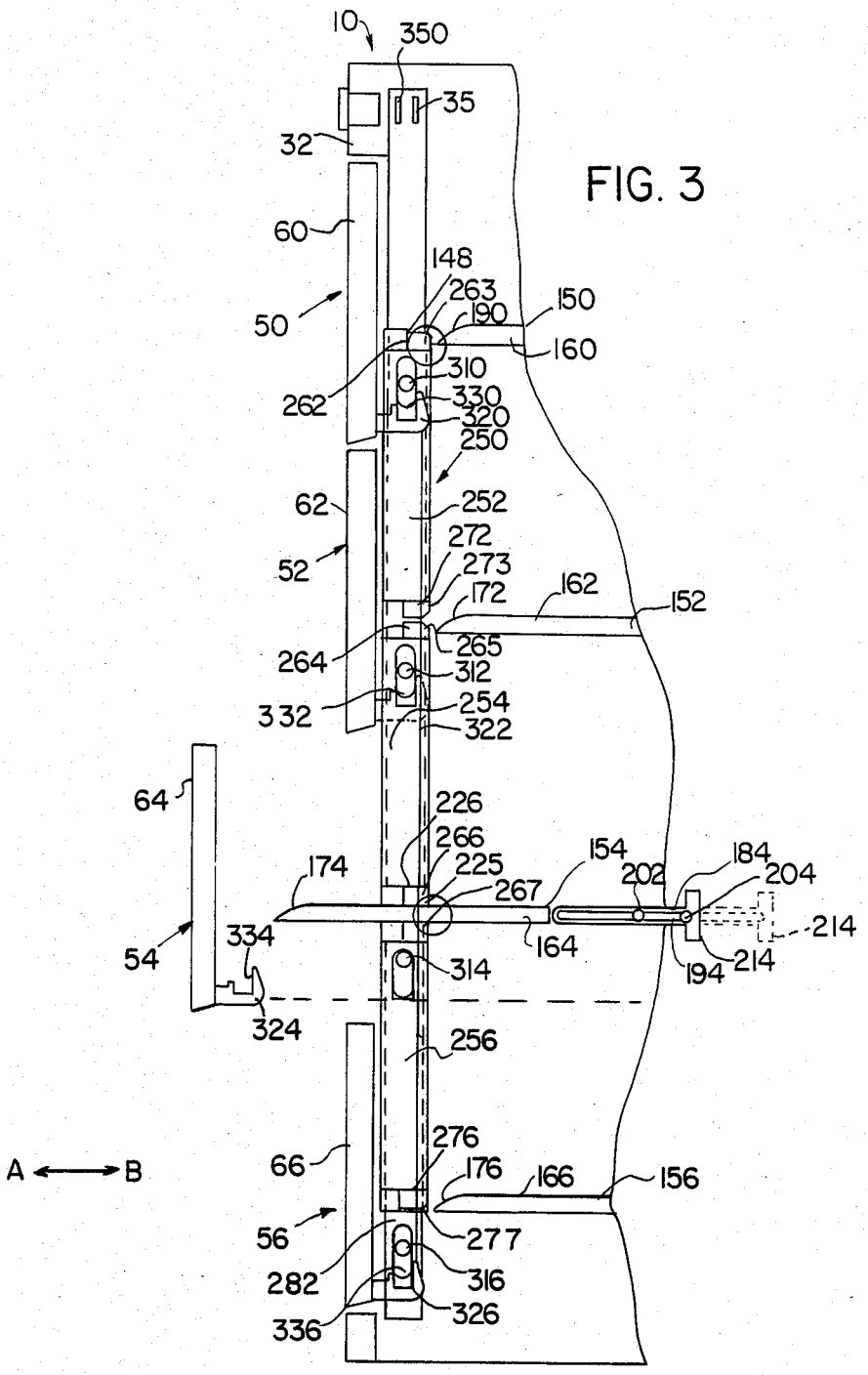
FIG. 3 is an enlarged side eleveation view of the file front portion of the cabinet of FIGS. 1 and 2 with the cabinet side cut away to better show details of the interlock and lock mechanisms of the instant invention.
Figure 6:
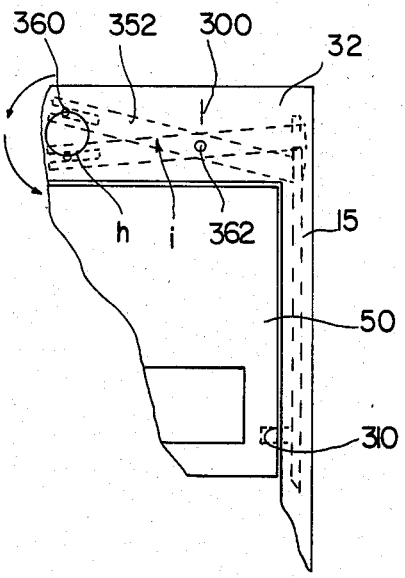
FIG. 6 is a schematic view of the upper right front portion of the cabinet of FIGS. 1 and 2 showing a portion of the cabinet lock mechanism in dot dash lines.

With respect to drawer 54 (FIG. 3), for example, as drawer 54 is pulled out from housing 10 (direction of arrow A) nose 174 (FIG. 3) of interlock track 154 will engage curved portion 275, of lower actuator block 274 of interlock bar 254, and coact with same to raise interlock bar 254 so that actuator block 274 rides along the top of track 154 as shown in FIG. 3. Continued movement of drawer 54 (in the direction of arrow A) keeps interlock bar 254 in its raised condition with actuator block 274 first riding along the top of track 154, and thereafter riding along the top of extender 184 (FIG. 4) as drawer 54 is pulled out to its full extension with respect to housing 10. As drawer 54 is first moved in the direction of arrow A extender 184 will be positioned as shown in FIG. 3 with its curved edge proximate body portion 164 of track 154. When drawer 54 has been withdrawn from housing almost to its full extension stop bar 214 of extender 184 will butt up against lower actuator block 274 of interlock bar 154 and upper actuator block 266 of interlock bar 156. Thereafter, further movement of extender 184 will stop but continued movement of drawer 54 (to its full extension - FIG. 4) will be permitted because fasteners 204 will slide in elongated slot 194 to permit the movement of track 154 and drawer 54.

When interlock bar 254 is intially raised up, due to its coaction with interlock track 154 of moving drawer 54, it, in turn, will raise all interlock bars disposed thereabove. In this instance only interlock bar 252 will be so raised up. Such movement of interlock bar 252 will place upper actuator block 262 thereof with its flat portion in the path of forward travel (direction of arrow A - FIG. 3) of interlock track 150 of drawer 50. The movement of interlock bar 254 to its raised condition will have also placed upper actuator block 264 thereof with its flat portion in the path of forward travel of interlock track 152 of drawer 52. Thus, all drawers (50, 52) above the pulled out drawer (54) will be positively prevented from being moved from their positions with their drawer fronts (60, 62) flush with the face of housing 10.

Drawers disposed below the pulled out drawer 54 (in this instance only drawers 56) will also be prevented from forward movement (direction of arrow A - FIG. 3) because upper actuator block 266 of interlock bar 256 will be prevented by interlock track 154 of drawer 54 from any upward movement and, as such, prevent upward movement of interlock bar 256. Lower actuator block 276 of interlock bar 256 will thus prevent forward movement of interlock track 166 of drawer 56.

The coaction between the interlock track of any drawer and its respective interlock bar will thus similarly prevent forward movement of all other drawers in a manner similar to that described above. Thus, withdrawal of top drawer 50 will move its interlock track 150 over upper actuator block 262 of interlock bar 252 to keep all interlock bars from being raised (i.e. in their FIG. 3 positions), and with their respective actuator blocks blocking forward movement of the interlock tracks of the drawers below and therefore of the drawers. Withdrawal of lower drawer 56 will move all interlock bars 256, 254, 252 up and as described above prevent forward movement of drawers 50, 52 and 54.

Return of drawer 54 to its closed position (in the direction of arrow B - FIG. 3) will first move stop bar 214 against the back of housing 10. Thereafter, interlock track 154 will slide with respect to extender 184 until fasteners 204 reassume their FIG. 3 positions at which time drawer 54 will be in its closed position. As drawer 54 approaches its closed position actuator block 274 slides down nose 174 of interlock track 154 until the two separate. Thereafter, interlock bars 254 and 252 drop back into their FIG. 3 positions; and all interlock bars are free to move upwardly when the next drawer is pulled forward.

The file cabinet is also provided with a lock mechanism 300 (FIGS. 6 and 7) including a first lock bar 302 disposed at side 14 of housing 10 and a second lock bar 304 disposed at side 15 of housing 10. Lock bars 302, 304 extend the full height of housing 10 and are located at their respective cabinet sides in appropriately formed vertical frame recesses. Lock bar 304 is located behind the interlock stack 250. Each lock bar includes lock pins 310, 312, 314, 316 extending therefrom and positioned respectively for coaction with lock hooks 320, 322, 324, 326 attached respectively to a lower back corner of drawer fronts 60, 62, 64 66. Lock hooks 320, 322, 324, 326 are formed with lock recesses 330, 332, 334, 336 respectively of a size to receive pins 310, 312, 314, 316.

It is important to note that lock bar 304 is positioned closely behind interlock stack 250; and that lock pins 310, 312, 314 extend through elongated slots 340, 342, 344 formed through interlock bars 252, 254, 256. This permits relative movement between interlock stack 250 and lock bar 304 and thus independent operation of each mechanism.

A pair of slots 350 are formed proximate the top of each lock bar (only slots 350 for lock bar 304 are shown - FIG. 7). A first end of a lock linkage 352 extends into slot 350 of lock bar 304 while a second end thereof is disposed for coaction with a cam type lock 360. Lock linkage 352 is pivoted on a pin 362 fixed behind front 32 of housing 10. A similar lock linkage (not shown) is pivoted on a pin (not shown) to the other side of lock 360 for coaction with lock 360 and the other lock bar in a manner similar to the coaction between lock 360, linkage 352 and lock bar 304.

The action of lock 360, linkage 352, lock bar 304 and the other linkage and lock bar are conventional. Thus, when a key turns the cylinder of lock 360 to locked condition linkage 352 is pivoted clockwise about pin 362 (FIG. 6) lock bar 304 will move down and pins 310, 312, 314, 316 thereof will move into recesses 330, 332, 334, 336 respectively of hooks 320, 322, 324, 326 to lock all closed drawers in their closed positions. The lock bar and lock pins on the other side of housing 10 act in a similar manner to lock drawers 50, 52, 54, 56 closed.

Lock bar 304 is smaller cross-sectional dimension than interlock bars 252, 254, 256 of interlock stack 250 and is located behind interlock stack 250. The lock bar on side 14 of housing 10 is, however, of the same cross-sectional dimension as interlock bars 252, 254, 256 of interlock stack 250.

From the above description, it will thus be seen that there has been provided a novel and improved drawer interlock and lock system for a lateral type file cabinet.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention, coming within the proper scope and spirit of the appended claims, will of course readily suggest themselves to those skilled in the art. Thus, while there has been described what is at present considered to be preferred embodiments of the invention, it will thus be obvious to those skilled in the art that various changes and modifications may be made therein, without departing from the invention, and it is therefore, aimed in the appended claims to cover all such changes and modifications as fall within the true spirit and scope of the invention, and it is understood that, although I have shown the preferred form of my invention, that various modifications may be made in the details thereof, without departing from the spirit as comprehended by the following claims.

What is claimed is:

1. An interlock mechanism for the storage members of a storage cabinet for preventing movement of more than one storage member at a time from a storage position within the cabinet to a position extending from the cabinet; the storage cabinet having a plurality of storage members each disposed in the cabinet for movement between the storage position and the extended position; the interlock mechanism comprising:

(a) interlock track means fixedly secured to an identical side of each of said storage means;

(b) interlock bar means including a plurality of interlock bars each movably arranged in a stack one above the other at a side of said cabinet and in proximity to said interlock track means, their being one less interlock bar than the number of storage members in said plurality of storage members;

(c) actuator block means carried by each of said interlock bars and proximity to said interlock track means for cooperation therewith; and (d) extender means carried by each of said interlock track means for relative movement with respect thereto between an extended position and a retracted position;

(e) said interlock track means of a predetermined one of said storage members, upon movement of the storage member from its position within the cabinet towards its position extending therefrom, coacting with said actuator block means of a predetermined one of said interlock bars and thereby to prevent movement of all others of said storage members;

(f) said extender means being disposed to coact with said actuator block means of said predetermined interlock bar upon movement of said predetermined storage member a first distance extending from the cabinet, and such that continued movement of said storage member to a second distance extending from said cabinet effects relative movement of said interlock track means carried by said storage member so moving and said extender means carried thereby.

2. An interlock mechanism for the file drawers of a file cabinet for preventing movement of more than one file drawer at a time from a storage position within the cabinet to a position extending from the cabinet; the file cabinet having four file drawers each disposed in the cabinet for movement between the storage position and the extended position; the interlock mechanism comprising:

(a) interlock track means fixedly secure to an identical side of each of said file drawers;

(b) interlock bar means including a plurality of interlock bars each movably arranged in a stack one above the other side of said cabinet and in proximity to said interlock track means, their being three interlock bars so that there is one less interlock bar than the number of file drawers in said plurality of storage members;

(c) actuator block means carried by each of said interlock bars and in proximity to said interlock track means for cooperation therewith;

(d) extender means carried by each of said interlock track means for relative movement with respect thereto between an extended position and a retracted position;

(e) said interlock track means of a predetermined one of said file drawers, upon movement of the file drawer from its position within the cabinet towards its position extending therefrom, coacting with said actuator block means of a predetermined one of said interlock bars and thereby to prevent movement of all others of said file drawers;

(f) said file drawers each have a bottom, opposed spaced sides, a back and a front all disposed to define a space therebetween, and being laterally disposed in the file cabinet; and (g) lock means carried by the cabinet, said lock means including;

(i) a first lock bar disposed to one side of the cabinet and movable between a locked position and an unlocked position;

(ii) a second lock bar disposed to the other side of the cabinet and movable between a locked position and an unlocked position;

(iii) lock means coating with said first lock bar and said second lock bar to move same between said locked positions and said unlocked positions;

(iv) pin means carried by each of said lock bars for coaction with hooks carried by each of said file drawers such that upon movement of said lock bars to said locked positions said pins coact with said hooks to prevent movement of said file drawers from said cabinet;

(v) one of said lock bars being disposed proximate said interlock bars.

3. The interlock mechanism of claim 1, wherein said coaction of said interlock track means with said actuator block means effects a raising movement of said predetermined interlock bar and of all others of said interlock bars thereabove in said stack such that said actuator block means carried thereby are moved into the path of movement of said interlock track means of said storage members disposed in the cabinet above the storage member so moved to prevent movement thereof; said interlock track means of said storage member so moved coacting with said actuator block means of said interlock bar disposed beneath said predetermined interlock bar to prevent movement thereof and of any storage member in the cabinet below said predetermined storage member.

4. The interlock mechanism of claim 3, wherein said extender means permits movement of said predetermined storage member to its full extended position.

5. The interlock mechanism of claim 4, wherein said actuator block means coacts with said extender extension means to maintain said predetermined interlock bar so moved while said predetermined storage member is so moving to its fully extended position.

6. The interlock mechanism of claim 1, wherein there are four storage members and three interlock bars.

7. The interlock mechanism of claim 6, wherein said storage members are file drawers disposed in a file cabinet.

8. The interlock mechanism of claim 7, wherein said file drawers each have a bottom, opposed spaced sides, a back and a front all disposed to define a space therebetween.

9. The interlock mechanism of claim 8, wherein the file drawers are laterally disposed in the storage cabinet.

10. The interlock mechanism of claim 9, wherein lock means are carried by the cabinet, said lock means including;

(a) a first lock bar disposed to one side of the cabinet and movable between a locked position and an unlocked position;

(b) a second lock bar disposed to the other side of the cabinet and movable between a locked position and an unlocked position;

(c) lock means coacting with said first lock bar and said second lock bar to move said between said locked positions and said unlocked positions;

(d) pin means carried by each of said lock bars for coaction with hooks carried by each of said storage members such that upon movement of said lock bars to said locked positions said pins coact with said hooks to prevent movement of said storage members from said cabinet;

(e) one of said lock bars being disposed proximate said interlock bars.

11. The interlock mechanism of claim 2, wherein said pins of said one of said lock bars extend through suitable elongated openings formed in said interlock bars.

12. The interlock mechanism of claim 1, wherein said interlock track means is provided with a leading edge which is radiused and which is disposed for coaction with said actuator block means.

13. The interlock mechanism of claim 12, wherein said actuator block means includes a first actuator block carried at a lower end of each of said interlock bars and a second actuator block carried at an upper end of each of said interlock bars.

14. The interlock mechanism of claim 13, wherein each of said actuator blocks includes a curved portion disposed for coaction with said radiused leading edge of said interlock track means.

15. The interlock mechanism of claim 1, wherein stop pin means are carried by said cabinet for coaction with a bottom edge of the lower most one of said interlock bars to define for said interlock bars a rest position within the cabinet.

* * * * *